United States Patent [19]

Murrey, Sr.

[11] 4,205,842

[45] Jun. 3, 1980

[54] LAMINATED BOWLING ALLEY WITH BARRIER INTERFACE

[76] Inventor: Gordon W. Murrey, Sr., 14150 S. Figueroa, Los Angeles, Calif. 90061

[21] Appl. No.: 918,777

[22] Filed: Jun. 26, 1978

[51] Int. Cl.[2] ..... A63D 1/04

[52] U.S. Cl. ..... 273/51

[58] Field of Search ..... 273/51; 52/408; 428/460

[56] References Cited

U.S. PATENT DOCUMENTS

| | | | |
|---|---|---|---|
| 1,961,765 | 6/1934 | James | 273/51 |
| 2,039,580 | 5/1936 | Borders | 273/51 |
| 2,209,082 | 7/1940 | Debay | 273/51 |
| 2,969,983 | 1/1961 | De Vore | 273/51 |
| 4,146,223 | 3/1979 | Stottman | 273/51 |

OTHER PUBLICATIONS

"Synthetic Lane Surface", Bowling Magazine, Jan. 1977, p. 6.

DBA Products Co., Inc. Advertisement, Bowling Magazine, Jun. 1977, pp. 2 and 3.

*Primary Examiner*—Anton O. Oechsle

*Attorney, Agent, or Firm*—Fulwider, Patton, Rieber, Lee & Utecht

[57] ABSTRACT

A bowling alley construction utilizing a high pressure laminate having a hard plastic melamine external surface which simulates the conventional wooden laminated bedstock alley construction. In the lane section of the alley, the laminate is adhesively bound to a fiberboard layer which is secured to the top of the alley underbed. In the approach section and pin deck section, the laminate is adhesively bonded to rigid barriers which are affixed to a wooden underbed by means of adhesive and screws.

15 Claims, 6 Drawing Figures

LAMINATED BOWLING ALLEY WITH BARRIER INTERFACE

BACKGROUND OF THE INVENTION

1. Field of the Invention

The present invention relates generally to bowling alley constructions and, more particularly, to bowling alleys utilizing laminates having upwardly facing surfaces which simulate laminated bedstock.

2. Description of the Prior Art

In the past, bowling alleys have utilized crib understructure or sunken subway gutters for supporting bowling alley beds directly thereon. Such bowling alley beds are typically constructed of loose tongue-and-groove laminated bedstock fixed onto a base platform carried on top of the crib structure.

Not only is a tongue-and-groove laminated bedstock initially expensive to construct, but it is also expensive to maintain. The surfaces of such bowling alleys must be regularly sanded and refinished. Also, depsite the fact that hardwoods are used in the areas of ball and pin impacts, dents in the alley surface do occur when bowlers drop bowling balls onto the alley surface. Even the bowling pins will dent and nick the hardwood finish when struck with sufficient force. These dents must be removed by relatively deep sanding before refinishing.

With the development of relatively high pressure-type laminate materials, special products were developed for refinishing bowling alleys such as, for example, a laminate called PERMA-LANE, manufactured by General Electric. This product is a high pressure laminate with an integral hard plastic surface which has the appearance of a conventional laminated wooden bedstock bowling alley and is applied directly to the sanded surface of an existing alley.

While such constructions worked well in the lane sections of the alley, in the approach and pin deck sections the relatively thin laminate supported only by thin planking proved unsuccessful because the laminate could not withstand the impact vibrations and the adhesives bonding the laminate to the wooden planking would loosen and the laminate would separate. The loose tongue-and-groove construction, even when nailed together, could not fully resist relative movement between adjacent slats and as the slats became thinner as a result of repeated sanding of the surface thereof such resistance to relative movement decreased thus allowing the nails to loosen and creating a greater tendency for the laminate to break its bond with the alley deck when forces were applied to the top surface thereof. It is believed that such separation was further, at least partially, due to the difference in hardness between the relatively soft wood and the hard laminate.

Therefore, there has been a need for a technique for using such special products on thin planked alleys which would withstand the vibrations in the high impact sections of the alley. The present invention satisfies that need.

SUMMARY OF THE INVENTION

The present invention provides a bowling alley construction which utilizes a relatively thin base platform of the crib construction as an integral part of the bowling alley itself. A high pressure laminate material having an external surface covered with a hard plastic melamine material which has the appearance of the conventional wooden bowling alley is fixed to the top surface of the base of the crib to form the lane section of the bowling alley. The relatively thin planking and laminate combination is adequate in the lane section as a bowling ball merely rolls in this section and there is no impact problem.

In the areas of the alley which receive ball and pin impacts, mainly the approach section together with an impact area immediately ahead of the foul line where ball impacts do occur, and the pin deck section which receives the impact of the rebounding pins, are reinforced by a relatively rigid barrier layer sandwiched between the bed and laminate and securely bonded to such bed to resist and distribute ball or pin impacts.

The use of the barrier layer, which may be of any relatively rigid material such as metal or plastic, provides sufficient support for the laminate even though the underlying planking is relatively thin and flexible. The bond between the barrier layer and the underlying bed is preferably reinforced by mechanical fastening means such as screws or pegs for resistance to separation of the barrier and bed during impact vibration.

Thus, the use of a reinforcing barrier layer between the laminate layer and the relatively thin base planking results in a bowling alley construction which is much less costly than conventional tongue-and-groove bedstock, but which provides sufficient resistance to impacts. Further objects and advantages of the present invention will become apparent from a consideration of the following detailed description.

DESCRIPTION OF THE PREFERRED EMBODIMENT

Figure 1:
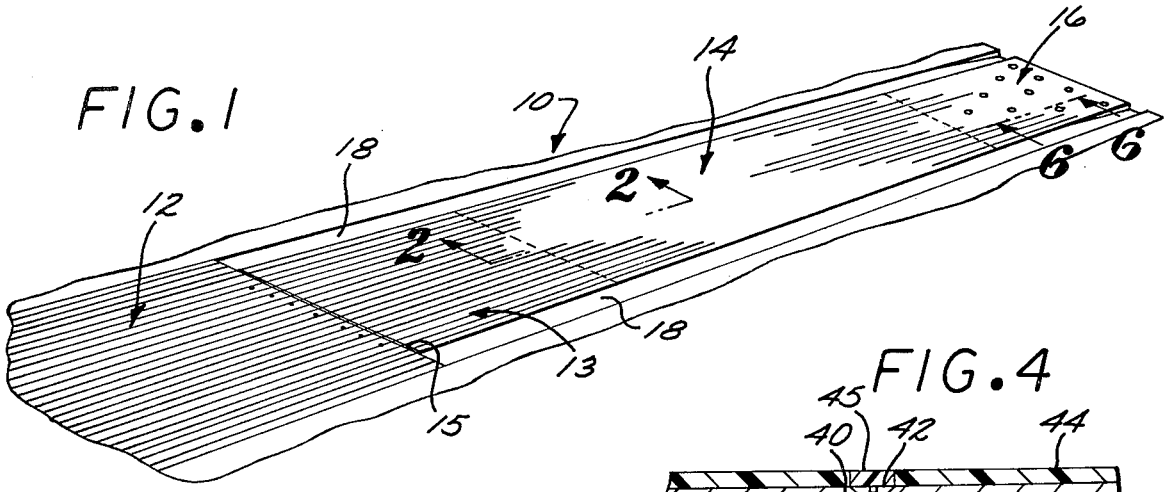
FIG. 1 is a partial perspective view of a bowling alley constructed in accordance with the present invention.

Turning now to the drawings, particularly FIG. 1 thereof, a bowling alley 10 constructed in accordance with the present invention includes an approach section 12, pin-impact section 13, lane section 14 and a pin deck section 16. The approach section 12 is reinforced, and is approximately 15 feet long. The reinforced ball section 13 projects from between 8 and 16 feet beyond the foul line and the total lane length between the foul line and pin deck is conventionally sixty feet. The reinforced pin deck 16 projecting beyond such lane is approximately five feet in length. Conventional gutters 18 on either side of the lane and pin deck sections 14 and 16, respectively, also can be seen.

Figure 2:
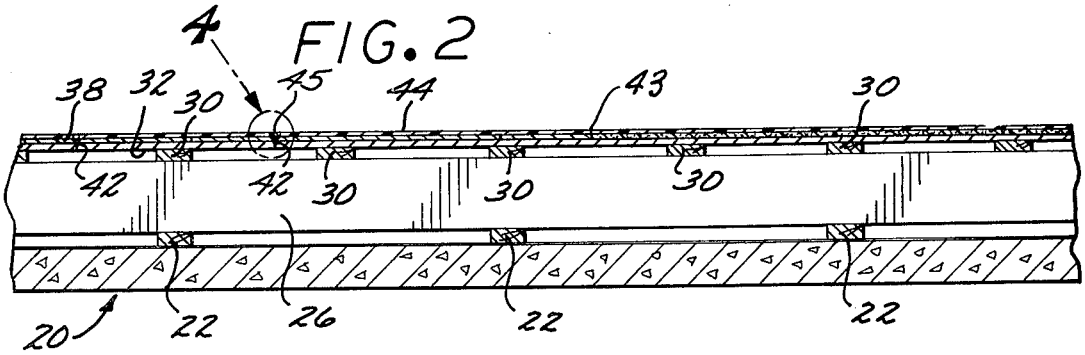
FIG. 2 is an enlarged cross sectional view taken in the direction of lines 2—2 of FIG. 1.
Figure 3:
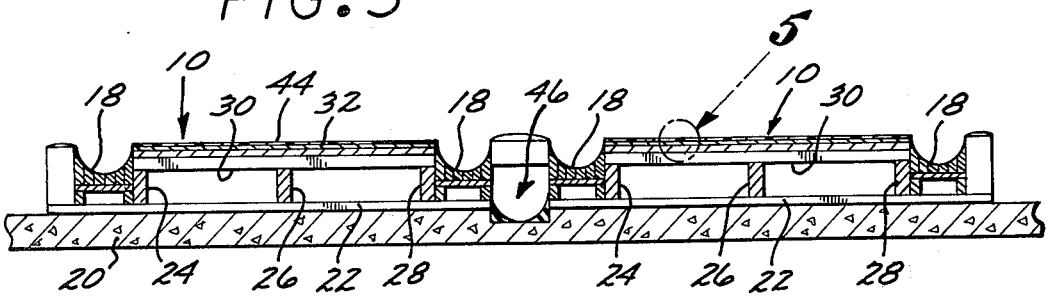
FIG. 3 is a cross sectional view of a crib foundation type bowling alley including a subway ball return utilizing the laminate construction of the present invention.
Figure 5:
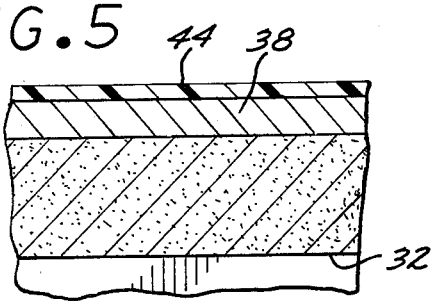
FIG. 5 is an enlarged fractional cross sectional view taken in the direction of line 5—5 of FIG. 3.

In accordance with the present invention, the understructure for bowling alley 10 including the approach section 12, the lane section 14 and the pin deck section 16, may be of crib frame under-construction including a foundation which is best illustrated in FIGS. 2 and 3. Basically, a rigid foundation 20 such as concrete floor or the like, supports the complete structure. A series of foundation stringers 22 are aligned transversely to the direction of the bowling alley on the foundation 20. Typically, the foundation stringers 22 may be 2" by 4" and run beneath the gutters 18 as well as the alley 10. Mounted on the foundation stringers 22 in the direction of the length of the bowling alley are base support plank members 24, 26 and 28, being the lefthand, center and righthand support members, respectively. In crib-type construction, the base support members 24, 26 and 28 are typically 2" by 10" planks stood on edge to elevate the construction above the foundation and a sunken subway ball return, generally designated 46, is formed between adjacent alleys to serve as a return for both alleys. Across the top of the elongated support members are transversely mounted and spaced base stringers 30 which supply the supporting structures for the base of the crib type bowling alley construction. The base stringers 30 are typically 2" by 4" and spaced about 13" apart to adequately support the base.

A relatively inexpensive underbed 32 is formed across the stringers 30 either as a single piece or a plank construction for the length of the alley 10 and has a thickness of about one inch. A base planking thickness of approximately one inch provides adequate support.

Figure 4:
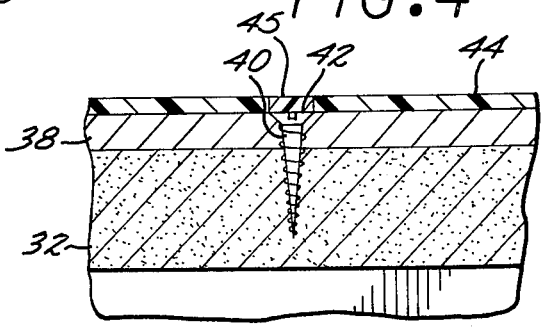
FIG. 4 is an enlarged fractional cross sectional view of the area indicated by line 4 of FIG. 2.
Figure 6:
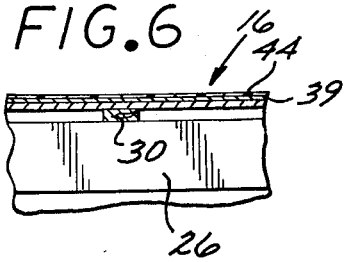
FIG. 6 is a longitudinal sectional view taken along the line 6—6 of FIG. 1.

The approach, pin-impact and pin deck sections 12, 13 and 16 are high impact areas and are constructed of a combination of underbed 32 together with respective rigid barrier plates 38 and 39 (FIGS. 2 and 6) constructed of any suitably rigid material, such as steel, aluminum or hard plastic, as is best seen in FIG. 4. The combined thickness of the relatively flexible, inexpensive underbed 32 and relatively rigid barriers 38 or 39 is sufficient to withstand the weight of forces applied thereto. The base 32 is relatively flexible, and the barriers 38 and 39 may be between $\frac{3}{8}$" and 5/16", depending upon the material used. These thicknesses in this combination have been found to be adequate to be highly resistant to impacts.

The reinforcing barrier plates 38 and 39 are adhesively fixed, preferably with a rubber-based contact cement, to the underbed 32 and, in addition, a plurality of mechanical fastening means, such as illustrated screw 42 (FIG. 4), preferably extend through bores 40 in such barriers and secures such barrier against loosening under repeated impact and vibration. A fiberboard spacer 43 overlies the lane underbed 32 between the impact section 13 and pin deck 16 and is of the same thickness as the barriers 38 and 39 to have the top surfaces thereof level with one another.

Adhesively secured, preferably with a rubber-based contact cement, to the approach, impact, lane and pin deck section is the final finishing layer 44 which is composed of a high pressure laminate with an integral external hard plastic melamine surface whose appearance in the preferred embodiment, is that of a conventional laminated bedstock type of bowling alley. Such finishing layer, in some applications, is colored to provide a novel and aesthetic bowling alley appearance. A previously mentioned example of a commercially available material with these characteristics is PERMA-LANE, manufactured by the General Electric Company. This product is available in ranges of about $\frac{1}{8}$" to 3/16" thick. Finishing layer 44 covers the entire bowling alley 10 and, in cross section, the completed bowling alley of the present invention is illustrated in FIG. 3 showing the raised bowling alleys 10 separated by a subway return 46 in a conventional manner.

It will be appreciated that the bowling alley construction of the present invention provides for installation of the barriers 38 and 39 at the construction site or by prefabrication at the factory prior to shipment to the construction site. When such laminations are emitted together prior to shipment, the barriers 38 and 39 will be provided with pre-drilled bores 40 for receipt of anchor screws 42; the cover layer 44 thereover being countersunk above such screws for receipt of covering plugs 45 (FIG. 4). Thus, when the barriers 38 and 39 and cover finishing layer 44 are prefabricated by cementing together at the factory, such laminations will come in predetermined lengths for installation on site. The bores in the underbed 32 for receipt of the screws 42 may be quickly and rapidly drilled, these screws 42 inserted, and the heads thereof covered by plugs 45.

It will be appreciated that the bowling alley construction of the present invention is relatively economical to construct, as compared to the prior art tongue-and-groove construction, while giving the same appearance and performance as prior art constructions. In operation, as the bowler approaches the foul line 15, assuming his ball release stance, the increased force of his feet weighting down on the approach area 12 will be resisted by the combined resistance of the underbed planks 32 and the barrier plate 38 which act to distribute such forces over a greater area of the supporting framework and resist excessive flexing of the underbed 32 which could result in breaking of the bond with the overlying cover layer 44 leading to separation thereof from its supporting surface.

When the bowling ball is released it will make point contact with the cover layer 44 above the barrier plate 38 in the impact section 13 and the force of such point contact will be distributed to a larger support area of the underbed 32 by means of the barrier plate 38. This distribution of force will tend to reduce relative shifting between the cover 44 and barrier plate 38 thus retaining the integrity of the bond between such cover and barrier plate.

The released ball will take its course down the lane, and in the case of the successful bowler will make contact with the bowling pins on the pin deck 16. The struck pins will fly from their stationary positions, resulting in many of such pins striking the end and side walls of the alley causing them to rebound back onto the pin deck 16, frequently resulting in point contact with great force. The laminated construction of the barrier plate 39 (FIG. 6) over the underbed 32 serves to resist such force and distribute such high forces over a greater area of the underbed, thus minimizing relative shifting of the cover 44 relative to the supporting barrier plate 39 thereby tending to maintain the integrity of the bond therebetween and preventing release of such cover.

From the foregoing, it will be apparent that the bowling alley construction of the present invention provides for economical construction while giving the appearance and performance of more expensive prior art alleys. Further, refinishing alleys built pursuant to such invention requires only removal and replacement of the finishing lamination, thus minimizing the expense of repair and maintenance.

Various modifications and changes may be made in the foregoing detailed description without departing from the spirit of the invention. Therefore, the invention is not to be limited, except by the following claims.

I claim:

1. A bowling alley construction having an approach section at one extremity thereof leading to a foul line, a ball impact section leading therebeyond for a selected distance, a pin deck at the extremity opposite said one extremity for supporting predetermined bowling pins thereon and a lane section leading from said impact section to said pin deck section, said alley construction comprising:

an underbed having a top surface subject to deformation or flexure by downwardly acting forces of a predetermined magnitude such as may result from normal impact of said bowling pins rebounding thereonto or bowling balls being lofted thereonto;

a thin synthetic finishing layer overlying said underbed, said layer having sufficient flexibility to flex downwardly under said downwardly acting forces;

a first barrier plate of metal or hard plastic in one of said approach, ball impact or pin deck sections, sandwiched between said underbed and thin synthetic finshing layer, said barrier plate being of a predetermined thickness, more rigid than said synthetic finishing layer and constructed of a hard rigid material, and having a substantially greater resistance and downward flexure than said underbed;

spacer means of said predetermined thickness sandwiched between said underbed and finishing layer throughout said alley in the areas not covered by said barrier plate and affixed to said underbed; and, bonding means bonding said finishing layer to said spacer means and barrier plate whereby said synthetic finishing layer will exhibit the desired finished appearance for said alley and said downwardly acting forces applied thereto in the area of said barrier plate will be resisted by such underlying barrier plate to minimize downward flexing of said finishing layer and limit relative movement between said barrier plate and overlying finishing layer to thus limit the strain applied to said bonding means due to downward flexing of said finishing layer.

2. A bowling alley construction according to claim 1, that includes:

bonding means affixing said barrier plate to said underbed.

3. A bowling alley construction according to claim 1, that includes:

mechanical fastening means fastening said barrier plate to said underbed.

4. A bowling alley construction according to claim 1, wherein:

said barrier plate projects from a point aft of the foul line defining the end of said impact section to a point at least eight feet in front of beyond said foul line.

5. A bowling alley construction according to claim 1, wherein:

said finishing layer is composed of a high pressure laminate integral with a surface layer which has the appearance of a conventional bowling alley surface.

6. A bowling alley construction as set forth in claim 1 that further includes:

through bores formed in said barrier plate; and, screws projecting through said bores and into said underbed to mechanically fasten said plate thereto.

7. A bowling alley construction as set forth in claim 1 wherein:

said underbed is constructed of wooden planking substantially one inch thick;

said barrier plates are constructed of metal; and said lane spacer means is constructed of fiberboard.

8. A bowling alley construction as set forth in claim 1 wherein:

said underbed is constructed of wood and said barrier plate has a thickness greater than said synthetic finishing layer.

9. A bowling alley construction as set forth in claim 1 wherein:

said spacer means terminates at an edge defining the end of one of the other of said approach, ball impact, or pin deck sections and said construction further includes;

a second barrier plate of said predetermined thickness sandwiched between said finishing layer of underbed in said one of the other of said approach, bill impact or pin deck sections, said second barrier plate being constructed of a hard, rigid material which at said predetermined thickness has a substantially greater resistance to downward flexure than said underbed.

10. A bowling alley construction as set forth in claim 1 wherein:

said synthetic finishing layer is no greater than 3/16 of an inch thick.

11. A bowling alley construction as set forth in claim 1 wherein:

said underbed is constructed of wood.

12. A bowling alley construction as set forth in claim 1 wherein:

said barrier plate is constructed of aluminum.

13. In a bowling alley construction of the type including an underbed defining an approach section leading to a foul line, a ball impact section leading beyond said foul line, and a bowling ball rolling alley leading to a pin deck section, all of which are covered by a synthetic laminated finishing layer, said construction including:

a first integral barrier plate of metal or hard plastic sandwiched between said underbed and synthetic laminated finishing layer projecting throughout at least one of said approach, ball impact or pin deck sections, said barrier plate being characterized in that it is more rigid and more resistant to deformation due to downwardly acting forces than said underbed and said finishing layer.

14. A bowling alley construction according to claim 13 wherein:

said barrier plate is constructed of aluminum.

15. A bowling alley construction as set forth in claim 13 that includes:

a second barrier plate having the same characteristics as said first barrier plate and projecting throughout one of the other of said approach ball impact or pin deck sections and further, being sandwiched between said underbed and finishing layer.

* * * * *

UNITED STATES PATENT AND TRADEMARK OFFICE

CERTIFICATE OF CORRECTION

PATENT NO. : 4,205,842

DATED : June 3, 1980

INVENTOR(S) : GORDON W. MURREY, SR.

It is certified that error appears in the above-identified patent and that said Letters Patent are hereby corrected as shown below:

In Claim 1, line 26, delete "and" and substitute therefor --to--.

Signed and Sealed this

*Twenty-fifth* Day of *November 1980*

[SEAL]

*Attest:*

SIDNEY A. DIAMOND

*Attesting Officer*

*Commissioner of Patents and Trademarks*